US007690740B2

(12) United States Patent
Blum

(10) Patent No.: US 7,690,740 B2
(45) Date of Patent: Apr. 6, 2010

(54) PULL-OUT GUIDE SYSTEM FOR DRAWERS

(75) Inventor: Lothar Blum, Höchst (AT)

(73) Assignee: Julius Blum GmbH, Höchst (AT)

( * ) Notice: Subject to any disclaimer, the term of this patent is extended or adjusted under 35 U.S.C. 154(b) by 0 days.

(21) Appl. No.: 12/149,724

(22) Filed: May 7, 2008

(65) Prior Publication Data

US 2008/0258592 A1 Oct. 23, 2008

Related U.S. Application Data

(63) Continuation of application No. PCT/AT2006/000430, filed on Oct. 23, 2006.

(30) Foreign Application Priority Data

Dec. 6, 2005 (AT) ..... GM824/2005 U

(51) Int. Cl.
*A47B 88/00* (2006.01)

(52) U.S. Cl. ..... 312/334.45; 312/334.33; 312/334.38

(58) Field of Classification Search ..... 384/18, 384/19, 47, 48, 49; 312/334.11, 334.13, 312/334.15, 334.16, 334.17, 334.25, 334.26, 312/334.32, 334.33, 334.45, 334.38, 334.6
See application file for complete search history.

(56) References Cited

U.S. PATENT DOCUMENTS 533,622 A * 2/1895 Turner ..... 312/334.12
2,309,217 A * 1/1943 Ruthenburg ..... 62/250
4,488,762 A * 12/1984 Rock ..... 384/18
5,302,030 A * 4/1994 Buie et al. ..... 384/18
6,379,045 B1 * 4/2002 Cirocco ..... 384/18
2004/0212284 A1 10/2004 Fitz

FOREIGN PATENT DOCUMENTS

| | | |
|---|---|---|
| DE | 19 66 323 | 8/1967 |
| DE | 25 40 581 | 3/1977 |
| DE | 30 35 927 | 4/1981 |
| DE | 38 22 575 | 1/1989 |
| DE | 203 06 212 | 6/2003 |
| DE | 20 2004 007 109 | 5/2005 |

OTHER PUBLICATIONS

International Search Report issued Feb. 6, 2007 in the International (PCT) Application of which the present application is the U.S. National Stage.
Austrian Search Report issued Jun. 1, 2006 in the corresponding Austrian patent application.

* cited by examiner

*Primary Examiner*—Janet M Wilkens
*Assistant Examiner*—Matthew W Ing
(74) *Attorney, Agent, or Firm*—Wenderoth, Lind & Ponack, L.L.P.

(57) ABSTRACT

Pull-out guide system for drawers, having a basic-structure rail, a drawer rail and, if appropriate, having a center rail arranged between these two rails. The load of the drawer is transmitted by way of a first rolling-contact body and at least one second rolling-contact body, and the first rolling-contact body has a smaller diameter than the at least one second rolling-contact body. The drawer rail is designed such that, when the drawer is in the closed state, the first rolling-contact body is subjected to loading by the drawer rail and, when the drawer is opened, the first rolling-contact body is relieved of the loading of the drawer rail.

17 Claims, 6 Drawing Sheets

PULL-OUT GUIDE SYSTEM FOR DRAWERS

This application is a continuation of International application PCT/AT2006/000430, filed Oct. 23, 2006.

BACKGROUND OF THE INVENTION

1. Field of the Invention

The present invention relates to a pull-out guide system for drawers with a carcass rail, a drawer rail and optionally with a middle rail arranged between these two rails, wherein the load of the drawer is transmitted by a first and at least one second rolling element.

2. Related Art

Pull-out guides of this type are usually arranged on both side walls of a furniture body and make it possible for the drawer or shelf base to run smoothly while at the same time bearing a high load. In addition to smooth running, lateral stability for the drawer or the individual parts of the pull-out guide are also relevant so that tilting of the drawer is largely prevented. When the drawer is in a closed position, in particular when bearing a high load, the foremost rolling elements or castors or the foremost region of a carriage arranged between the rails are subjected to a substantial stress. If plastic rollers are used as rolling elements, then these rollers can deform and thereby adversely impact the running behaviour of the pull-out guide.

BRIEF SUMMARY OF THE INVENTION

It is therefore an object of the present invention to propose a pull-out guide system of the type mentioned at the outset with improved running properties.

This is achieved according to an advantageous embodiment of the invention in that the first rolling element has a smaller diameter than the at least one second rolling element, wherein the drawer rail is formed such that when the drawer is in a closed position, the first rolling element is subjected to a load by the drawer rail and upon opening the drawer the first rolling element is relieved of the load of the drawer rail.

In this way the load of the drawer in its closed position is shifted onto the foremost rolling element or onto the foremost castor of the carriage, while the remaining rolling elements are released when the drawer is closed and thus are subjected to hardly any (or no) load. Although the first rolling element, movable in a longitudinal direction of the rail, which is subjected to a load when the drawer is closed, is subjected to mechanical stresses, a gradual flattening of this first rolling element is actually acceptable as, because of its small diameter and the special design of the drawer rail, the rolling element serves preferably only to support the drawer when it is closed, but preferably does not act as an actual castor when the drawer is in an open position.

In order to guarantee smooth running it can be provided that when the drawer is being opened the drawer rail runs, preferably exclusively, on the at least one second rolling element.

According to an embodiment of the invention, the diameter of the first rolling element is less than 98%, preferably less than 97%, of the diameter of the at least one second rolling element. Alternatively it can also be favourable if the diameter of the first rolling element is less than 0.1 mm, preferably less than 0.2 mm, smaller than the diameter of the at least one second rolling element.

According to a preferred embodiment of the invention, in the front end region of its running surface the drawer rail has an elevation facing towards the rolling elements. In a closed position of the drawer, the drawer rail rests with this elevation attached to or formed on the first rolling element, with the result that the first rolling element is subjected to a substantially vertical load. The provided elevation acts preferably exclusively on the first rolling element, and the remaining rolling elements are not subjected to a load by the elevation of the loading rail.

A structurally simple design can be provided such that the elevation is formed in one piece, preferably as an embossed area, on the drawer rail. This elevation can already easily be formed in the factory in one piece on the drawer rail by shaping the surface of the drawer rail with the help of an embossing die. Alternatively, the elevation can be attached as a separate component to the drawer rail. The separate component can for example be a small plastic plate which can easily be glued to the running surface of the drawer rail facing towards the rolling elements.

It can be provided that when the drawer is closed the elevation of the drawer rail rests, preferably exclusively, against the first rolling element. In the closed position, only the first (foremost) rolling element is subjected to a load, while the additionally provided rolling elements are largely load-free when the drawer is closed.

A preferred embodiment of the invention provides that the elevation has at least one slanted ramp for the rolling element (s). Thus a jerky closing of the drawer can be prevented, as the first rolling element does not have to roll over a step formed by the elevation.

A preferred embodiment of the invention provides that the first and the at least one second rolling element are arranged behind one another in the displacement direction of the drawer. A favourable design provides that the first and the at least one second rolling element are arranged in a movable carriage.

A favourable embodiment of the invention provides that the first rolling element has a coating made of plastic. This plastic material can have deformably elastic material properties. Of course, metal rolling elements can also be used advantageously.

The term "rolling element" also includes, in addition to all rolling elements provided for this purpose which can be moved between the rails, castors, cylindrical rollers, disks, balls or suchlike. Of course, all possible combination arrangements of the above-named rolling elements are also possible.

Further details and advantages of the present invention are described below in further detail with the help of the description of the Figures, with reference to the drawings. There are shown in:

DETAILED DESCRIPTION OF THE INVENTION

Figure 1A:
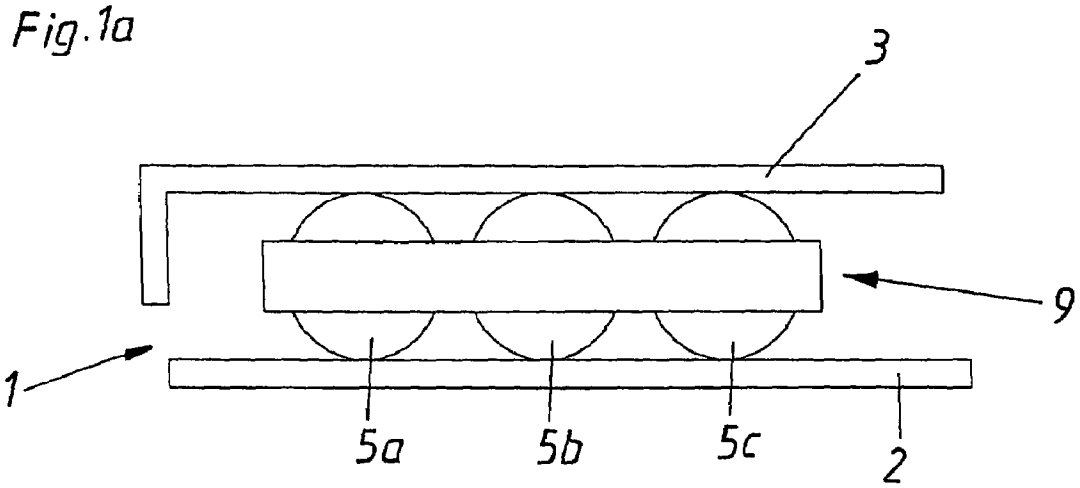
FIGS. 1*a*, 1*b* a schematic side view of a pull-out guide system according to the state of the art, with a carriage which can be moved between the carcass rail and the drawer rail, FIGS. 2*a*, 2*b* a schematic side view of a pull-out guide system according to the present invention, FIG. 3 a perspective view of a pull-out guide according to the invention with an embossed area in the drawer rail, FIGS. 4*a*-4*c* the pull-out guide according to the invention in a top view, a partly cut side view and in a detail view, FIG. 5 an exploded view of the pull-out guide, and FIGS. 6*a*, 6*b* the pull-out guide in a closed position and in an open position of the drawer rail.
Figure 1B:
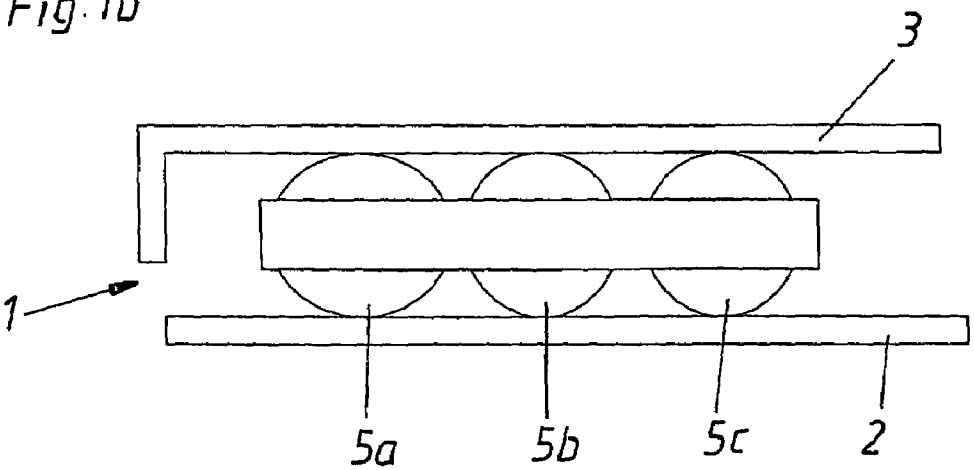

FIG. 1*a* and FIG. 1*b* show a schematic representation of a pull-out guide system 1 known according to the state of the art. A carriage 9 with its rolling elements 5*a*, 5*b*, 5*c* is arranged so as to be movable between the carcass rail 2 and the drawer rail 3. The carriage 9 ensures a stoppage-free running of the drawer rail 3 in relation to the carcass rail 2 when it is subjected to a high load. If the drawer remains in a closed position for a long period of time, the foremost rolling element 5*a* gradually becomes deformed, as this is subjected to a substantial load in particular when the front panels of the drawer are heavy. The rolling element 5*a* thus becomes an out-of-round shape over time, which has a negative effect on the running behaviour of the pull-out guide 1. In FIG. 1*b* the un-round oval shape of the rolling element 5*a* is schematically represented, wherein only slight deformations of the rolling element 5*a* already reveal a reduction in quality of the smooth running.

Figure 2A:
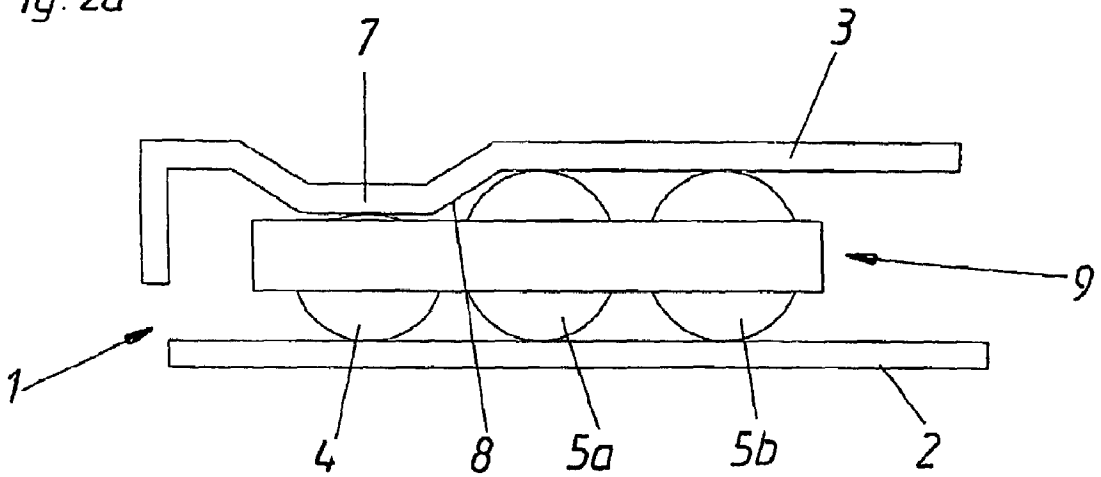
Figure 2B:
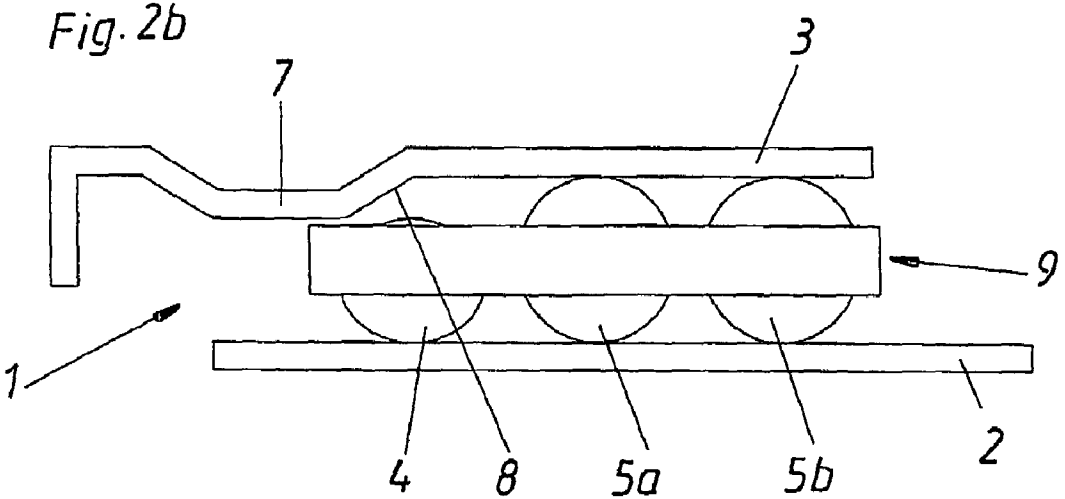

FIG. 2*a* and FIG. 2*b* show the pull-out guide system 1 according to the present invention. The load on the drawer is transmitted by a carriage 9 which is arranged so as to be movable between the carcass rail 2 and the drawer rail 3. Unlike the state of the art according to FIGS. 1*a* and 1*b*, the carriage 9 comprises a first rolling element 4 which has a smaller diameter than the two second rolling elements 5*a* and 5*b*. Also, an elevation 7 pointing towards the rolling elements 4, 5*a*, 5*b* is attached or arranged in the front end region of the drawer rail 3. The result is that when the drawer is closed the first rolling element 4 is subjected to a load by the drawer rail 3 and upon opening the drawer rail 3 relieves it of the load. In other words, when the drawer is closed only the first rolling element 4 is subjected to a load by the drawer rail 3 while the two other second rolling elements 5*a* and 5*b* are substantially load-free when the drawer is closed and therefore do not become deformed either. The first rolling element 4 thus preferably serves as a support roller when the drawer is closed, but upon opening of the drawer the drawer rail 3 runs preferably exclusively on the two second rolling elements 5*a* and 5*b*. If the first rolling element 4 is formed entirely or partly of plastic material, it may also happen that it deforms over time, as is shown in FIG. 2*b*. However, as the first rolling element 4 does not serve as an actual castor, because of its smaller diameter, an un-round shape is no longer relevant. In an open position, the drawer rail 3 travels only on the two second rolling elements 5*a* and 5*b*. The elevation 7 is preferably formed in one part as an embossed area on the drawer rail 3, but can alternatively be attached to the drawer rail 3 as a separate component. The elevation 7 has at least one slanted ramp 8 for the at least first rolling element 4.

In the Figure shown, the slanted ramp 8 also serves as a stop for the second rolling element 5*a*.

Figure 3:
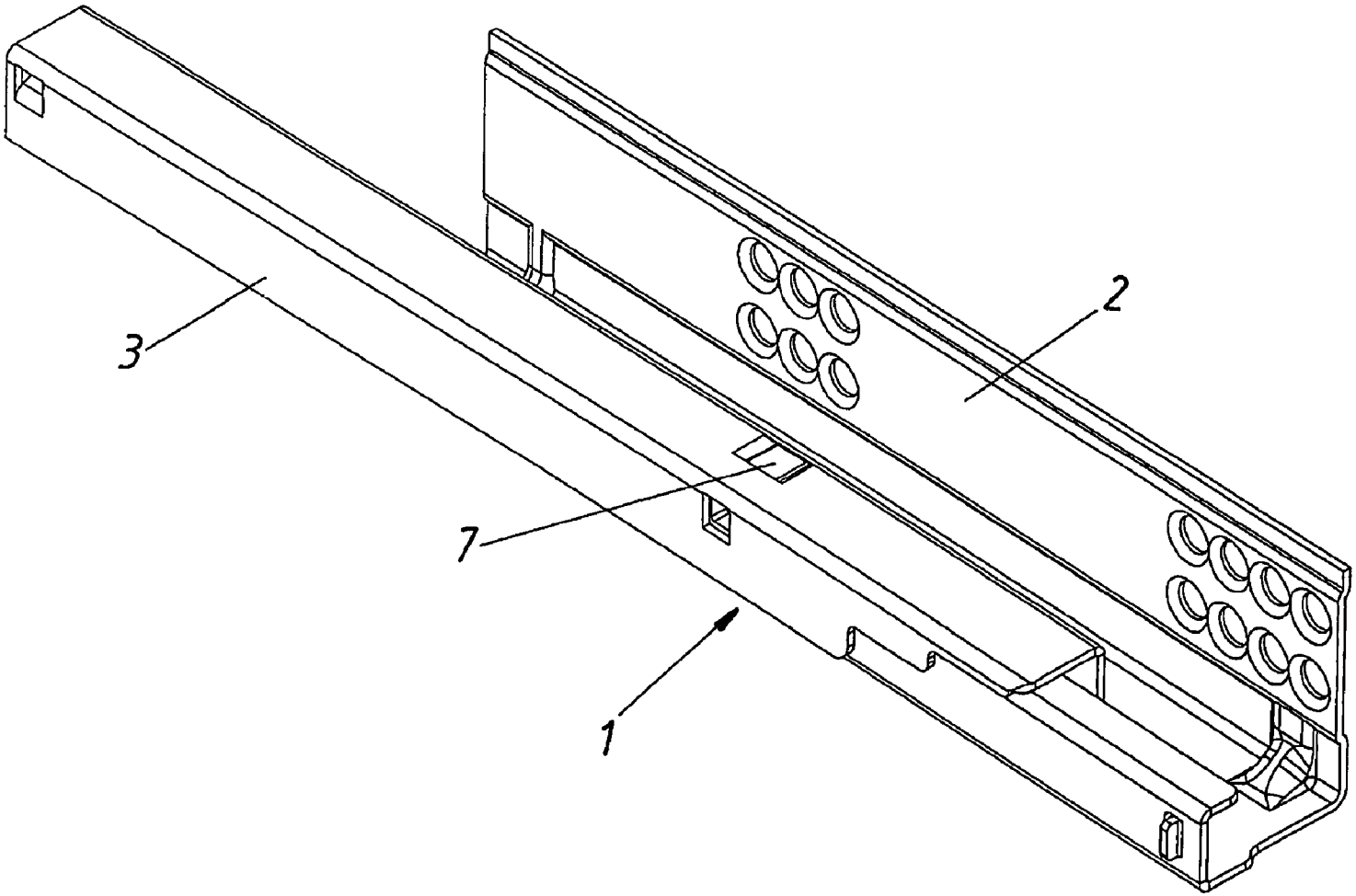

FIG. 3 shows a perspective view of the pull-out guide 1 with the carcass rail 2 which is attached on both sides to a side wall of an item of furniture. The drawer rail 3 can be displaced relative to the carcass rail 2. The elevation 7 of the drawer rail 3, formed as an embossed area, under which the smaller rolling element 4 is located when the drawer is closed, can also be seen. For reasons of clarity, further details of the pull-out guide 1 that are not essential to the invention, such as e.g. inclination adjustment of the drawer rail 3, attachments for the drawer base or suchlike, are not shown in the drawings.

Figures 4A, 4B, 4C:
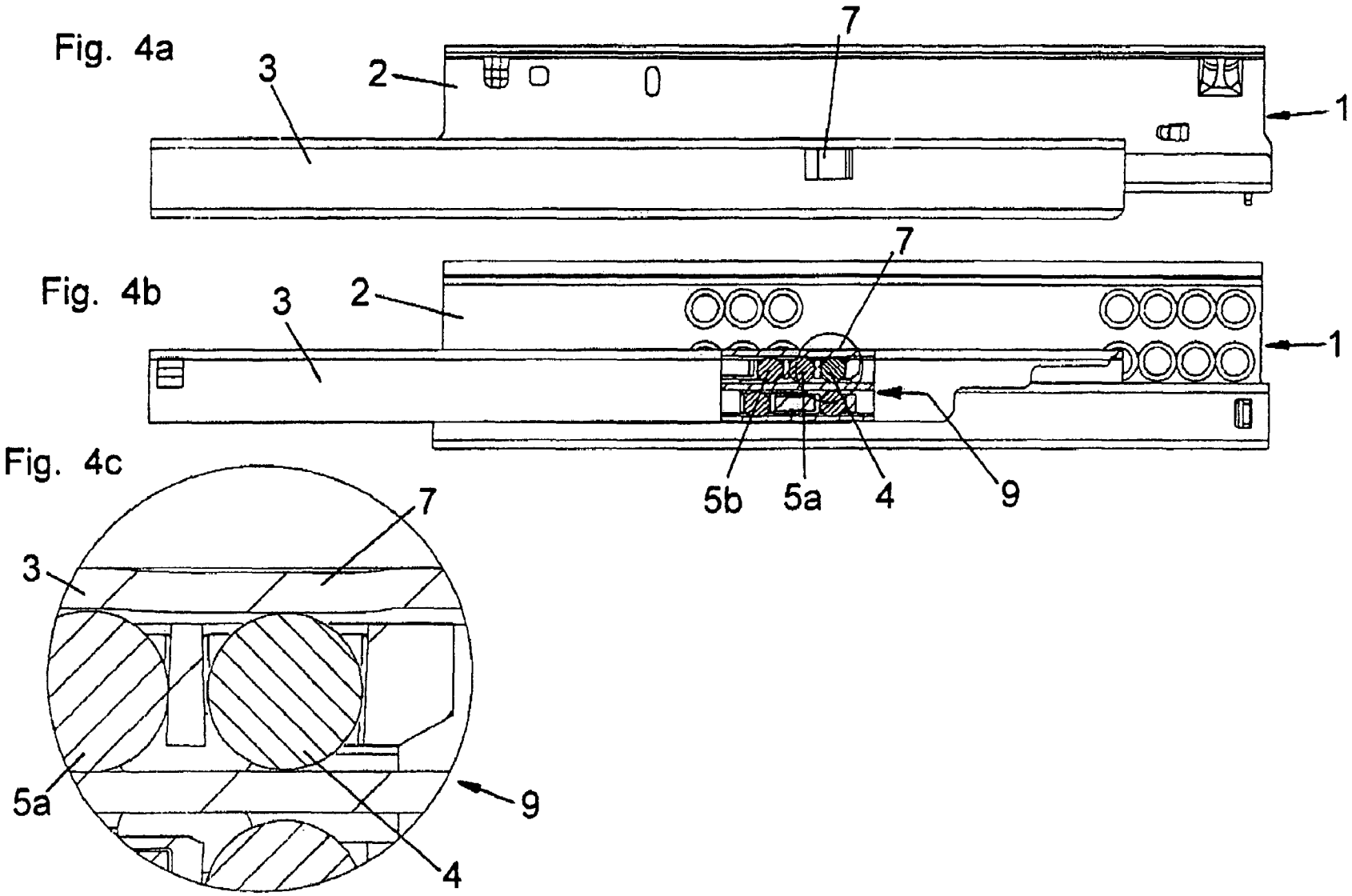

FIGS. 4*a*-4*c* show the pull-out guide 1 in different views. FIG. 4*a* shows the pull-out guide 1 in a top view, FIG. 4*b* shows a side view with a cross-section of the carriage 9. The carriage 9 includes a rolling element 4 with a diameter which is smaller compared with the diameters of the two other rolling elements 5*a* and 5*b*. In FIG. 4*b* the closed state of the pull-out guide 1 is shown in which the drawer rail 3 rests, with the elevation 7 pointing towards the rolling element 4, on the rolling element 4. FIG. 4*c* shows the detail view of the circle from FIG. 4*b*, wherein the first rolling element 4 is subjected to a load by the elevation 7 of the drawer rail 3.

Figure 5:
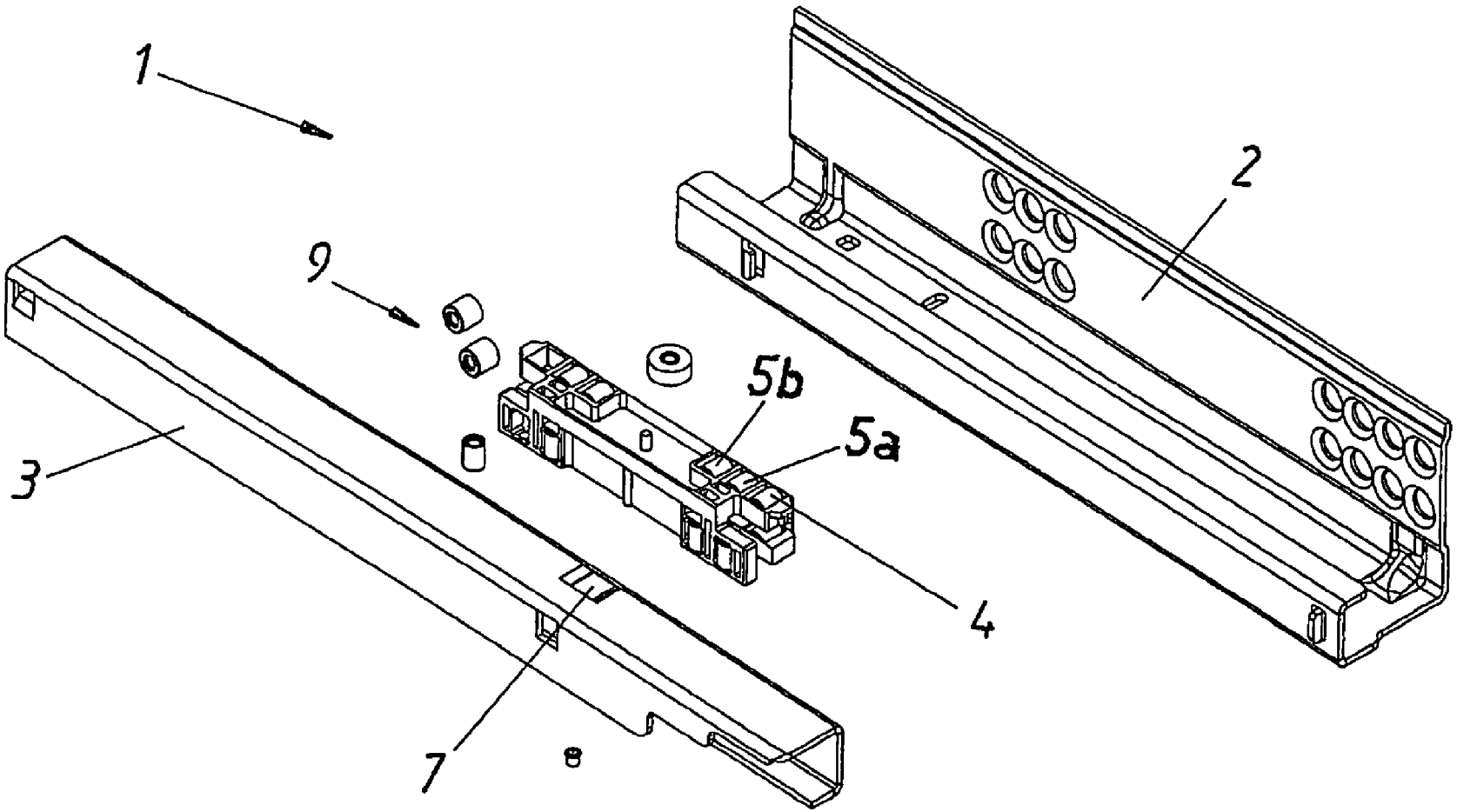

FIG. 5 shows an exploded view of the pull-out guide 1 with the carcass rail 2, the drawer rail 3 and the carriage 9 which can be moved between these two rails 2, 3. The foremost rolling element 4 of the carriage 9 is somewhat smaller than the two other rolling elements 5*a* and 5*b* and can be brought into engagement with the elevation 7 of the drawer rail 3 when the drawer is closed. The carriage 9 also has additional horizontal and vertical rollers which provide a favourable stability of the pull-out guide 1 during the opening and closing movement of the same.

Figure 6A:
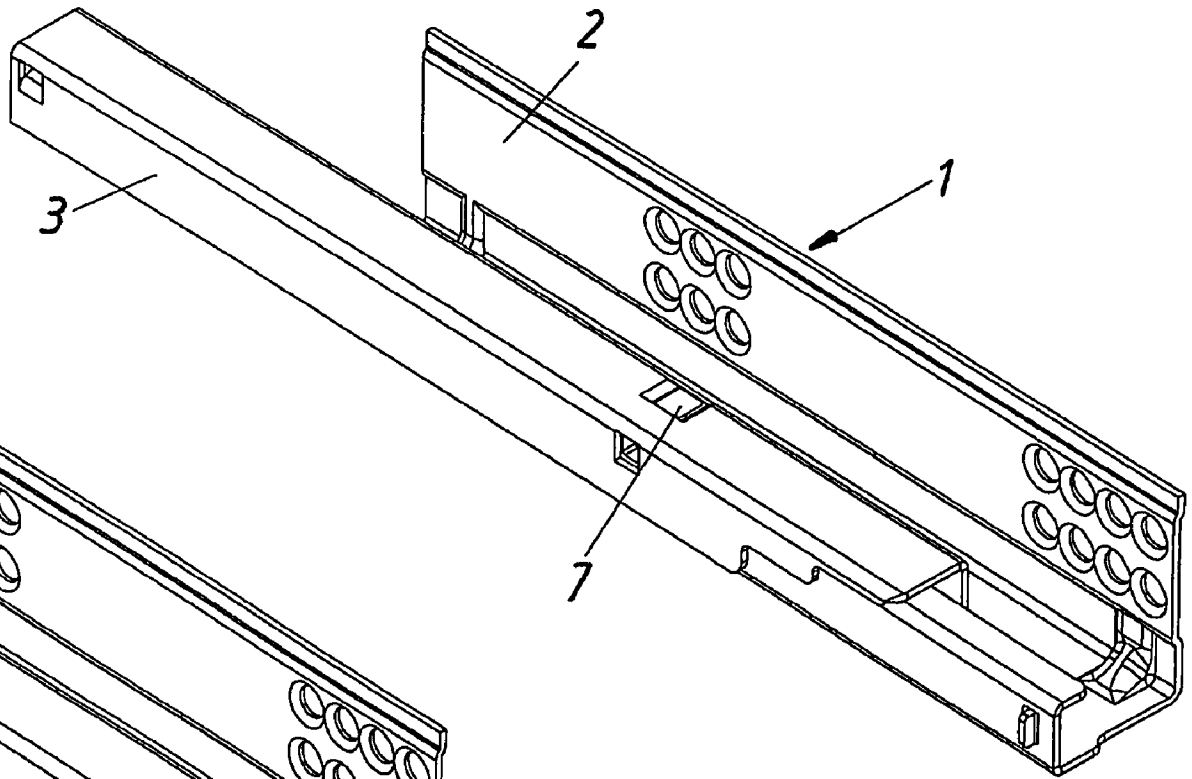
Figure 6B:
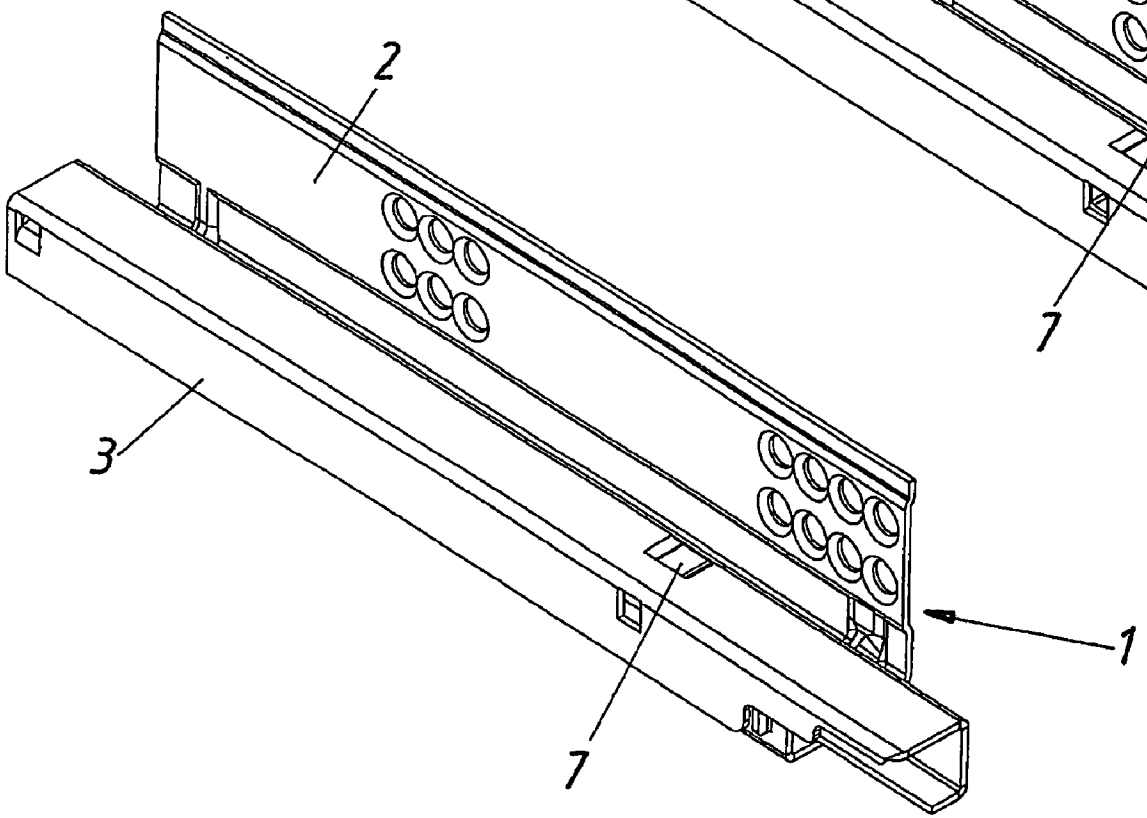

FIG. 6*a* shows the closed position of the pull-out guide 1 in which the elevation 7 of the drawer rail 3 rests on the first rolling element 4 (not visible) and the remaining rolling elements 5*a* and 5*b* are released from the drawer rail 3, with the result that these do not become deformed by the load of the closed drawer. FIG. 6*b* shows the pull-out guide 1 in an open position, wherein the first rolling element 4 is relieved of the weight of the drawer rail 3 and the drawer rail 3 runs only on the second rolling elements 5*a* and 5*b*.

The present invention is not limited to the shown embodiment examples, but covers or extends to all variants and technical equivalents which may come within the scope of the following claims. Also, the positions chosen in the description, such as e.g. above, below, laterally, relate to the customary installation position of the pull-out guide or to the directly described and represented Figure and in the event of a change in position are to be carried accordingly to the new position.

The invention claimed is:

1. A pull-out guide system for a drawer, said pull-out guide system comprising:

a drawer rail for fixing to the drawer;

a first rolling element disposed at said drawer rail;

at least one second rolling element disposed at said drawer rail, said first rolling element having a smaller diameter than said at least one second rolling element;

a carcass rail disposed along said drawer rail so as to hold said first rolling element and said at least one second rolling element between said drawer rail and said carcass rail; and an elevation for contacting said first rolling element, wherein said pull-out guide system has an open configuration and a closed configuration, wherein said first rolling element is held between said drawer rail and said carcass rail using said elevation in said closed configuration of said pull-out guide system, and wherein said elevation rests on said first rolling element so that said first rolling element is subjected to a load by said drawer rail in said closed configuration of said pull-out guide system, and said elevation does not contact said first rolling element and said first rolling element is not subjected to a load by said drawer rail in said open configuration of said pull-out guide system.

2. The pull-out guide system according to claim 1, wherein upon opening the drawer the drawer rail runs on the at least one second rolling element.

3. The pull-out guide system according to claim 1, wherein in an open position of said drawer rail, the drawer rail runs exclusively on said at least one second rolling element.

4. The pull-out guide system according to claim 1, wherein a diameter of said first rolling element is less than 98% of a diameter of said at least one second rolling element.

5. The pull-out guide system according to claim 1, wherein a diameter of said first rolling element is less than 97% of a diameter of said at least one second rolling element.

6. The pull-out guide system according to claim 1, wherein a diameter of said first rolling element is less than 0.1 mm smaller than a diameter of said at least one second rolling element.

7. The pull-out guide system according to claim 1, wherein a diameter of said first rolling element is less than 0.2 mm smaller than a diameter of said at least one second rolling element.

8. The pull-out guide system according to claim 1, wherein said drawer rail comprises said elevation in a front region of a running surface, and wherein said elevation faces towards said first rolling element.

9. The pull-out guide system according to claim 8, wherein said elevation is made as an embossment formed on said drawer rail.

10. The pull-out guide system according to claim 8, wherein said elevation comprises at least one slanted ramp for said first rolling element.

11. The pull-out guide system according to claim 1, wherein said first rolling element and said at least one second rolling element are arranged behind one another in a displacement direction of said drawer.

12. The pull-out guide system according to claim 1, wherein said first rolling element and said at least one second rolling element are arranged in a movable carriage.

13. The pull-out guide system according to claim 1, wherein at least said first rolling element consists entirely or partly of plastic material.

14. The pull-out guide system according to claim 1, wherein at least said first rolling element is formed as a castor.

15. The pull-out guide system according to claim 1, wherein at least said first rolling element is formed as a cylindrical roller.

16. The pull-out guide system according to claim 1, wherein at least said first rolling element is formed as a disk.

17. The pull-out guide system according to claim 1, wherein at least said first rolling element is formed as a ball.

* * * * *